US008297747B2

(12) United States Patent
O'Leary

(10) Patent No.: US 8,297,747 B2
(45) Date of Patent: Oct. 30, 2012

(54) SEAL FOR INKJET INK TANK

(75) Inventor: Kevin J. O'Leary, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 319 days.

(21) Appl. No.: 12/786,468

(22) Filed: May 25, 2010

(65) Prior Publication Data

US 2011/0292137 A1 Dec. 1, 2011

(51) Int. Cl.
*B41J 2/175* (2006.01)

(52) U.S. Cl. ..... 347/86; 347/84; 277/630

(58) Field of Classification Search ..... 347/84–87; 29/428; 277/630
See application file for complete search history.

(56) References Cited

U.S. PATENT DOCUMENTS

| | | | | |
|---|---|---|---|---|
| 6,464,339 | B1 | 10/2002 | Ardito | |
| 8,172,386 | B2 * | 5/2012 | Petranek et al. | 347/86 |
| 2007/0139493 | A1 * | 6/2007 | Campbell et al. | 347/86 |
| 2008/0204524 | A1 | 8/2008 | Petranek et al. | |
| 2008/0204525 | A1 | 8/2008 | Warren et al. | |
| 2009/0251514 | A1 | 10/2009 | Causey et al. | |

FOREIGN PATENT DOCUMENTS

| | | |
|---|---|---|
| EP | 1464502 | 10/2004 |
| WO | 98/03339 | 1/1998 |

* cited by examiner

*Primary Examiner* — Ellen Kim
(74) *Attorney, Agent, or Firm* — Peyton C. Watkins

(57) ABSTRACT

A seal for at least one outlet port of an ink tank, the seal includes a seal member; and a seal retainer further includes a housing for the seal member; a first attachment member on a first side of the housing; a second attachment member on a second side of the housing, the second side being opposite the first side; a handle including a free end and a hinged end opposite the free end; and a hinge member disposed between the housing and the hinged end of the handle.

21 Claims, 12 Drawing Sheets

SEAL FOR INKJET INK TANK

CROSS REFERENCE TO RELATED APPLICATIONS

Reference is made to commonly assigned U.S. patent application Ser. No. 12/786,472 filed May 25, 2010 by Kevin J. O'Leary, entitled "Method of Sealing An Inkjet Ink Tank."

FIELD OF THE INVENTION

The present invention relates generally to an ink tank for an inkjet printer, and more particularly to a seal including a seal retainer for sealing at least one outlet port of the ink tank, for example during shipping and storage.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed; and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink tank is depleted. Detachably mounted ink tanks for a carriage printer typically contain only enough ink for up to about several hundred prints. This is because the total mass of the carriage needs be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank in the holding receptacle should be simple and reliable. Ink tanks can contain a single color ink, or they can have several ink chambers each containing a different color ink that is supplied to the printhead through a corresponding outlet port.

Inkjet ink includes a variety of volatile and nonvolatile components including pigments or dyes, humectants, image durability enhancers, and carriers or solvents. For proper operation of the inkjet printhead it is important that the ink transferred from the outlet port of the ink tank to the inlet port of the printhead have the appropriate balance of these ink components. Therefore, during shipping and storage of an inkjet ink tank it is common practice to provide a seal over the outlet port(s) of the ink tank in order to inhibit the evaporative loss of the volatile components of the ink. U.S. Pat. No. 6,464,339 discloses a removable seal that is adhesively attached over the outlet port of an ink tank. US Published Patent Application 2008/0204524 discloses a sealing device including a compliant sealing member and a retainer having a latching feature to facilitate latching of the sealing device to an ink tank and also a protective region for protecting a circuit device on the ink tank. The background section of US Published Patent Application 2009/0251514 describes seals that are attached to the ink tank by ultrasonic welds, heat stakes or mounting hardware. An advantage of ultrasonic welds holding a sealing member in place is that the seal can be made more impervious to evaporative loss of volatile components of the ink. However, particularly for ink tanks including a plurality of outlet ports, the number and extent of ultrasonic welds can require the user to apply a significant force to break the welds in order to remove the seal prior to installing the ink tank into the printhead.

What is needed is a seal and seal retainer for an ink tank that is highly effective in preventing evaporative loss of volatile ink components but enables the user to apply the force required in an easy and well-controlled fashion for breaking the weld joints that hold the seal in place.

SUMMARY OF THE INVENTION

The present invention is directed to overcoming one or more of the problems set forth above. Briefly summarized, according to one aspect of the invention, the invention resides in a seal for at least one outlet port of an ink tank, the seal comprising a seal member; and a seal retainer comprising; a housing for the seal member; a first attachment member on a first side of the housing; a second attachment member on a second side of the housing, the second side being opposite the first side; a handle including a free end and a hinged end opposite the free end; and a hinge member disposed between the housing and the hinged end of the handle.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
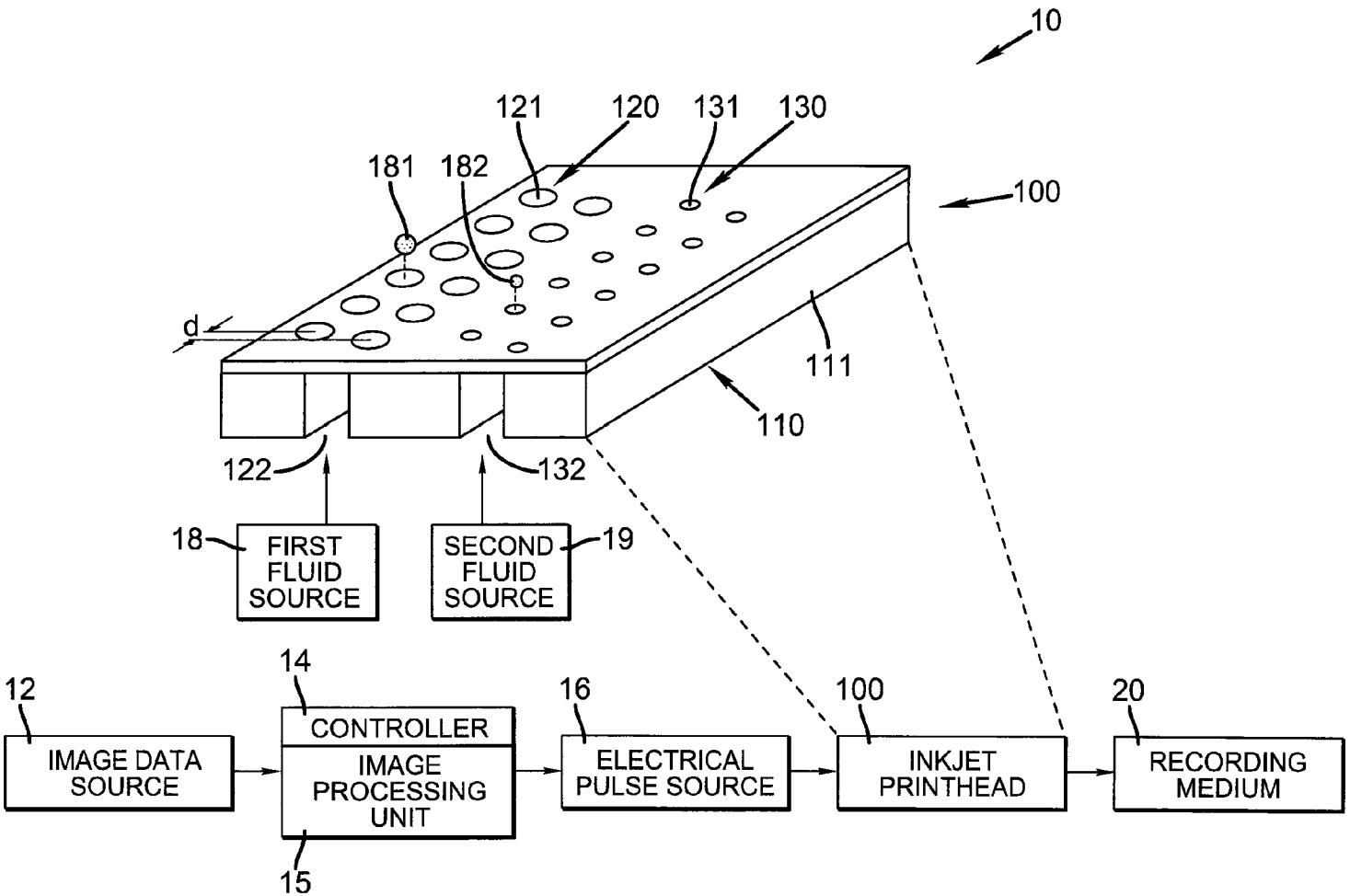
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
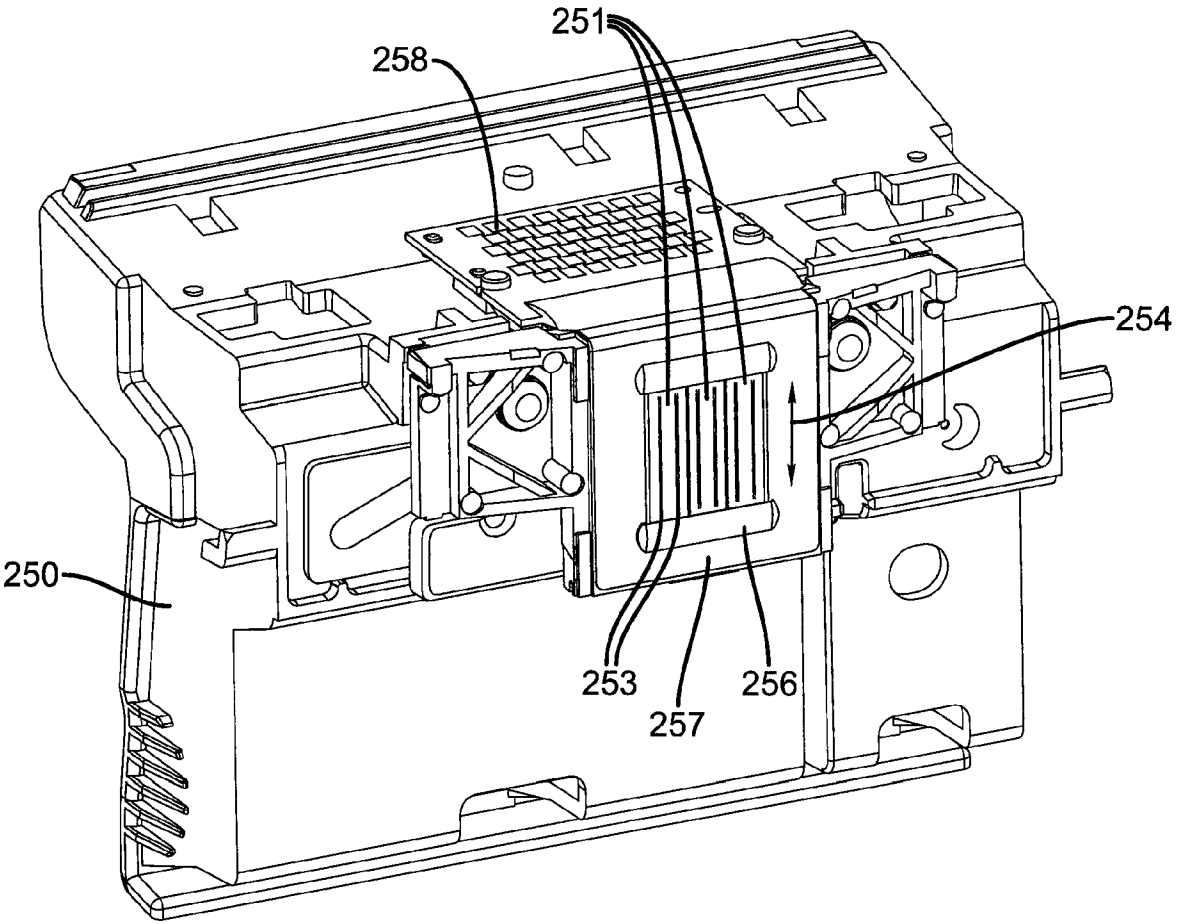
FIG. 2 is a perspective view of a portion of a printhead.

FIG. 2 shows a perspective view of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is parallel or substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
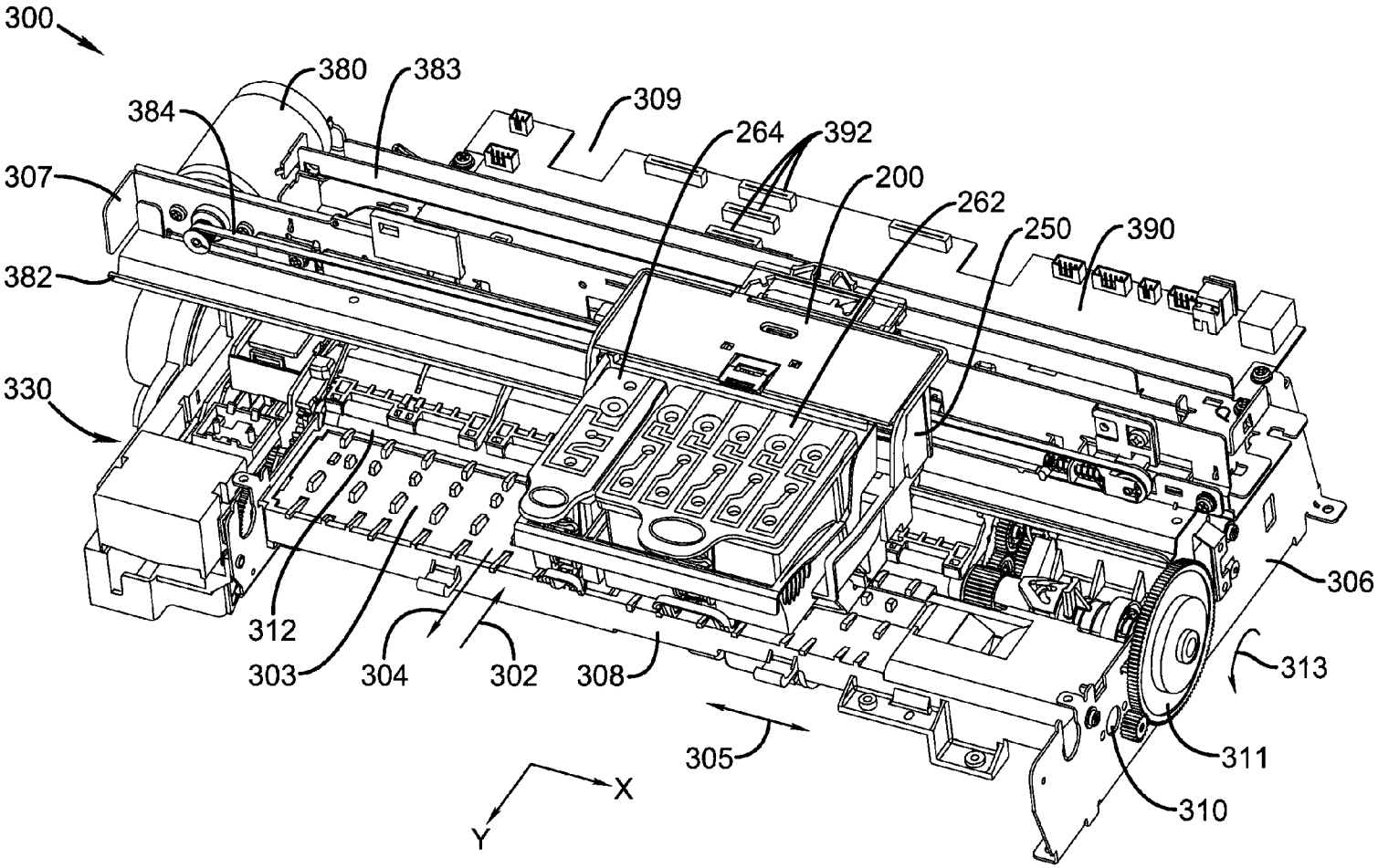
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are installed in the printhead 250. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. In other embodiments, rather than having a multi-chamber ink tank to hold several ink sources, all ink sources are held in individual single chamber ink tanks. Paper or other recording medium (sometimes generically referred to as paper or media herein) is loaded along paper load entry direction 302 toward the front of printer chassis 308.

Figure 4:
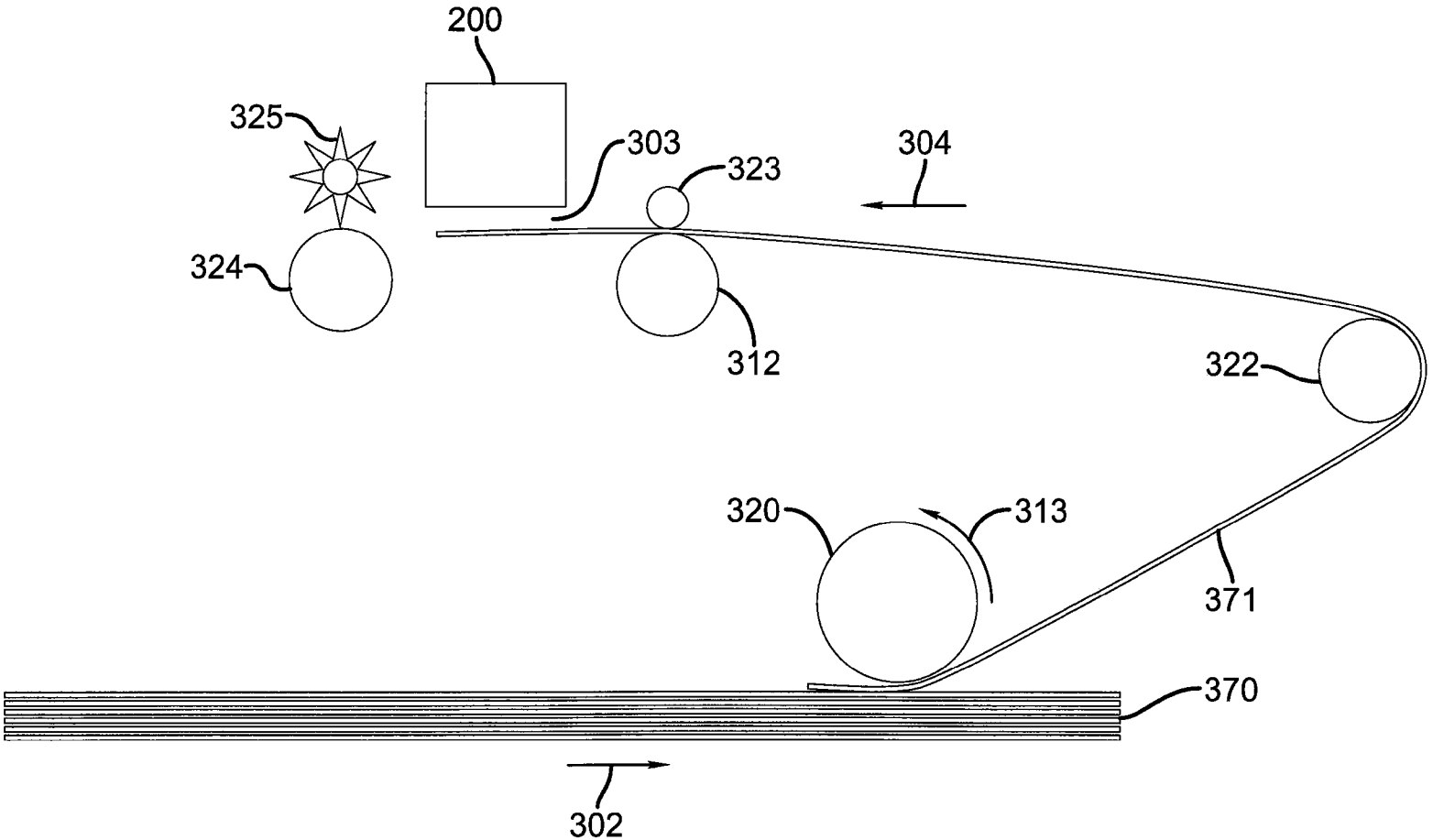
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
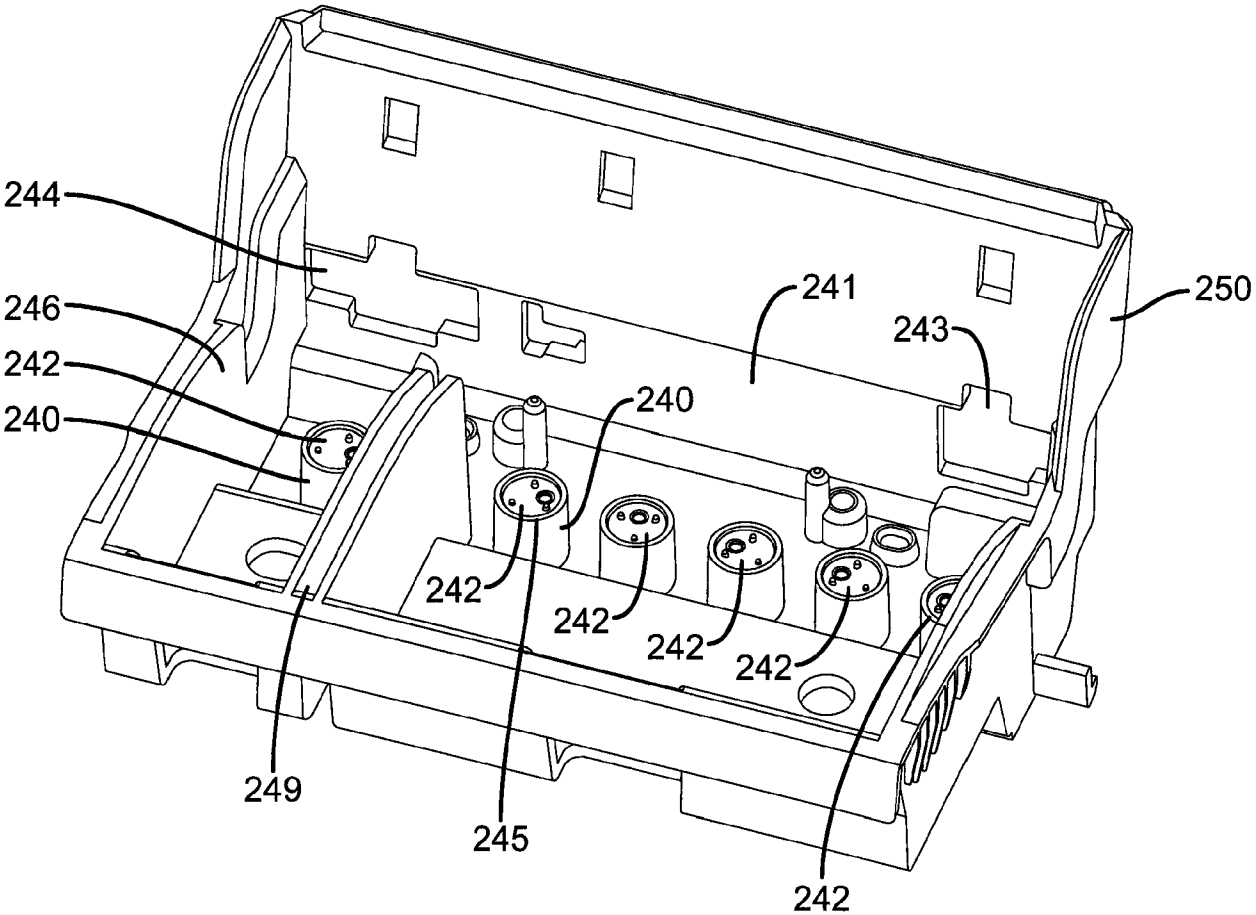
FIG. 5 is a perspective view of a portion of a printhead.

FIG. 5 shows a perspective view of printhead 250 (rotated with respect to FIG. 2) without either replaceable ink tank 262 or 264 mounted onto it. Multi-chamber ink tank 262 (shown in FIG. 6) is detachably mountable in ink tank holding receptacle 241 and single chamber ink tank 264 is detachably mountable in ink tank holding receptacle 246 of printhead 250. Ink tank holding receptacle 241 is separated from ink tank holding receptacle 246 by a wall 249, which can also help guide the ink tanks during installation. In some embodiments, pedestal 280 (see FIG. 6) of multi-chamber ink tank 262 is inserted into hole 243 of printhead 250 during mounting of the multi-chamber ink tank 264. A similar pedestal (not shown) on single chamber ink tank 264 is inserted into hole 244 of printhead 250 during mounting of the single chamber ink reservoir 264. Five inlet ports 242 are shown in region 241 that connect with outlet ports 272 (FIG. 6) of multi-chamber ink tank 262 when it is installed onto printhead 250, and one inlet port 242 is shown in region 246 for the outlet port (not shown) on the single chamber ink tank 264. In the example of FIG. 5 each inlet port 242 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the opening of outlet port 272 (see FIG. 6) of ink tank 262 or 264, so that the end 245 of each standpipe 240 is pressed into contact with a corresponding wick 277 at the opening of outlet port 272. In other words, wick 277 serves as a printhead interface member for the ink tank. When an ink tank is installed into the corresponding ink tank holding receptacle 241 or 246 of printhead 250, it is in fluid communication with the printhead because of the connection of the wicks 277 at outlet ports 272 with the ends 245 of standpipes 240 of inlet ports 242.

Figure 6:
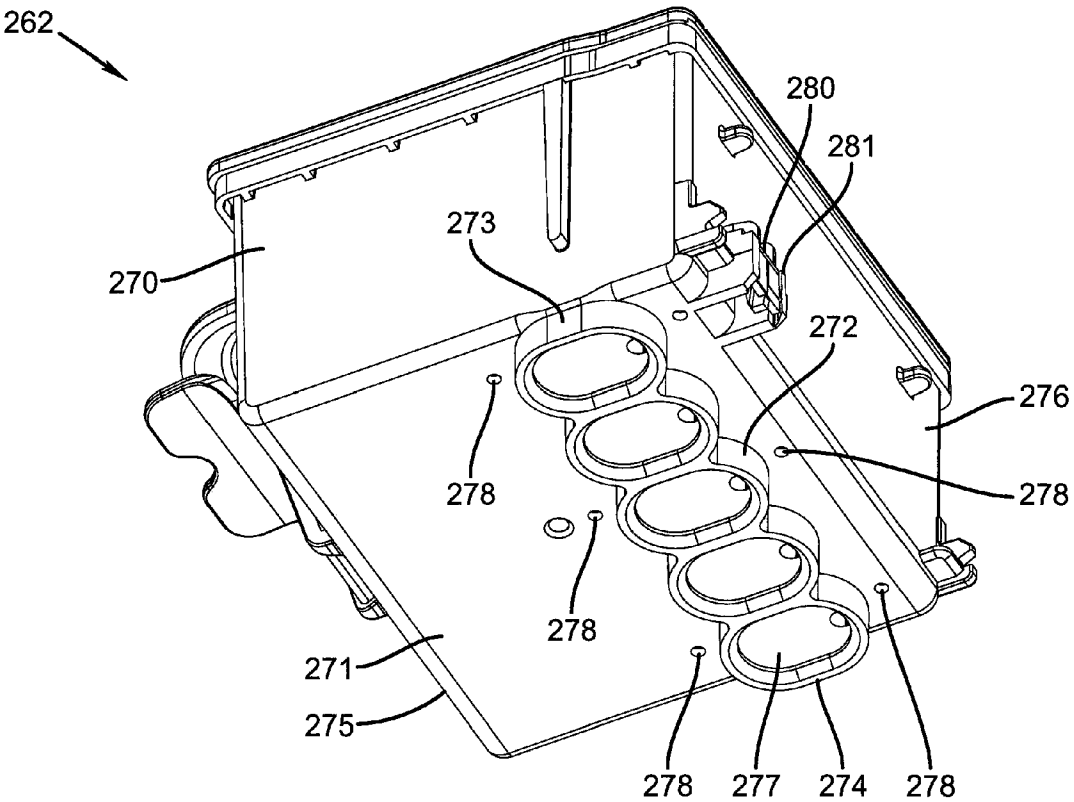
FIG. 6 is a perspective view of a multi-chamber ink tank according to an embodiment of the invention.

According to an embodiment of the invention, as shown in FIG. 6, multi-chamber ink tank 262 includes a body 270 having an outlet face 271, a first end wall 275 and a second end wall 276. A row of outlet ports 272 is disposed on outlet face 271. At the opposite ends of the row are end outlet ports 273 and 274. Outlet face 271 includes recesses or holes 278 that serve as attachment points for a seal retainer as described below. In some embodiments, an electrical device 281 is provided on a pedestal 280 extending from second end wall 276.

Figure 7:
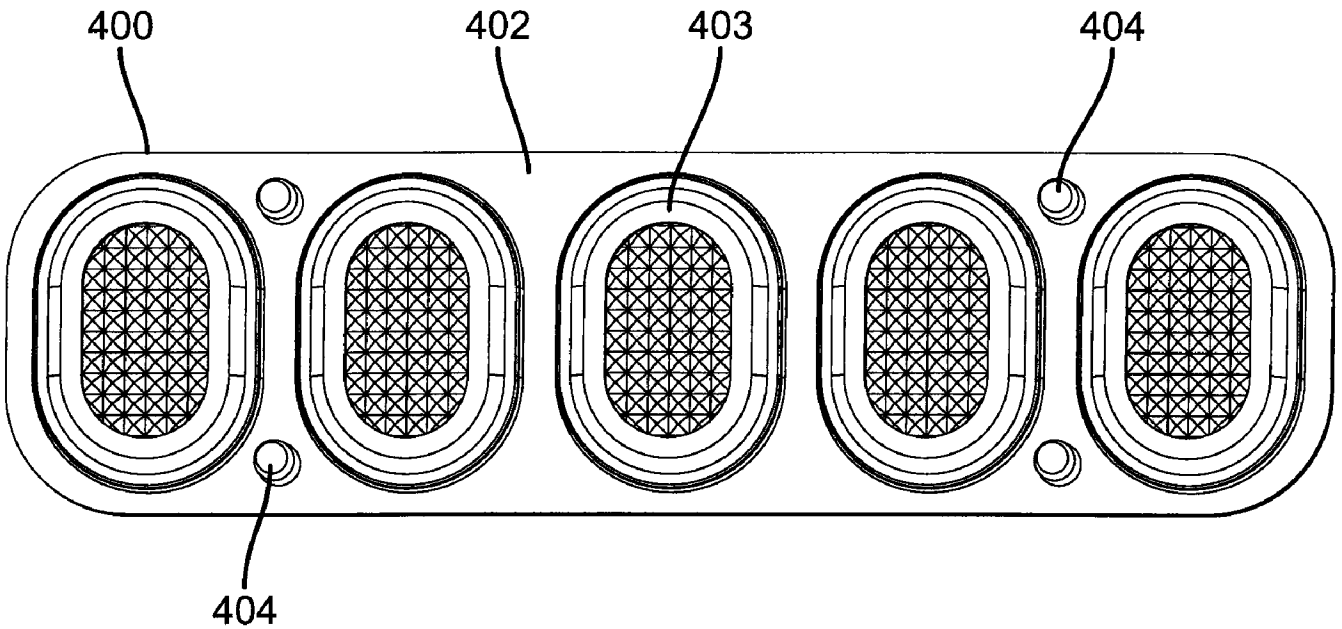
FIG. 7 shows a sealing face of a seal member according to an embodiment of the invention.
Figure 8:
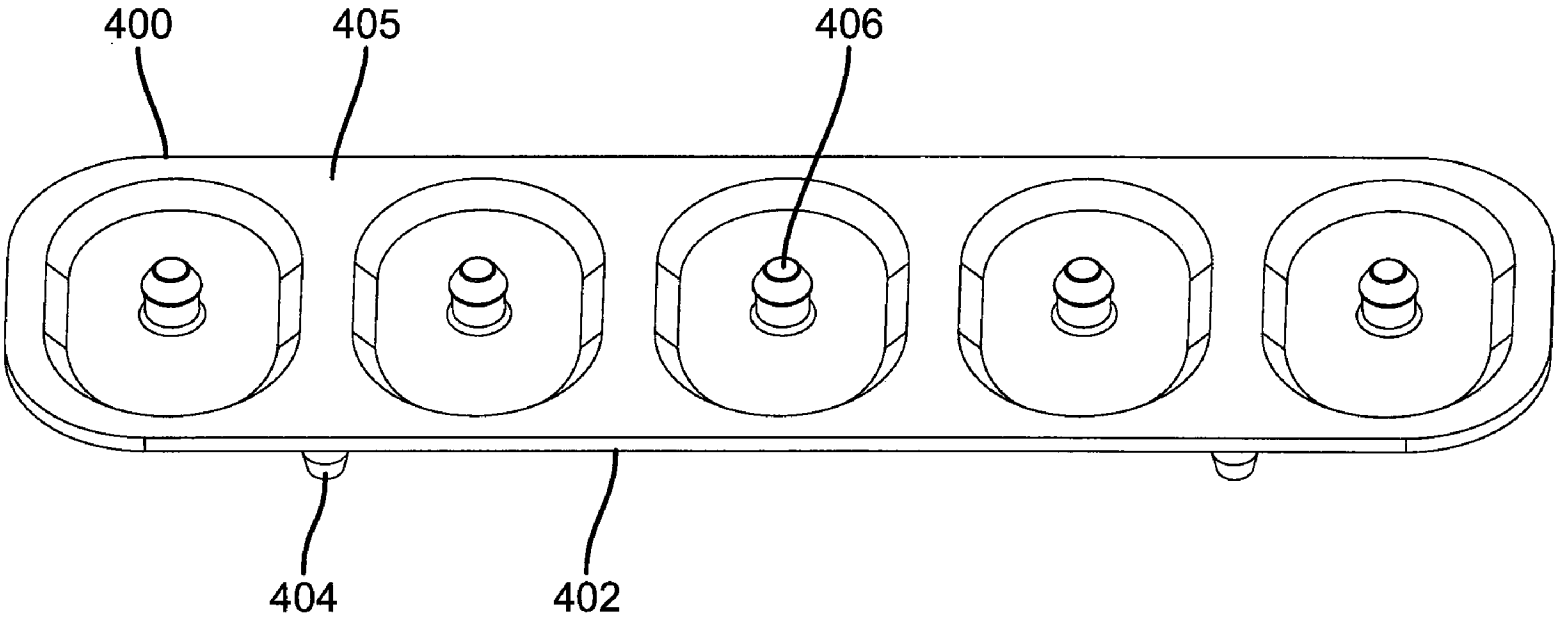
FIG. 8 shows an attachment face of the seal member of FIG. 7.

FIG. 7 shows seal member 400, which is used to seal outlet ports 272 (FIG. 6) of multi-chamber ink tank 262 during shipping and storage according to an embodiment of the invention. Seal member 400 can be made of an elastomeric material so that the port seals 403 on sealing face 402 provide a compliant seal against outlet ports 272 when seal member 400 is pressed against the outlet ports 272. The design of sealing face 402 is described in more detail in US Published Patent Application 2008/0204525. In the example shown in FIGS. 7 and 8, alignment posts 404 help to align seal member 400 relative to outlet ports 272. FIG. 8 shows the attachment face 405 (opposite sealing face 402) of seal member 400. Projections 406 can be press fitted into corresponding holes of a seal retainer as described below.

Figure 9:
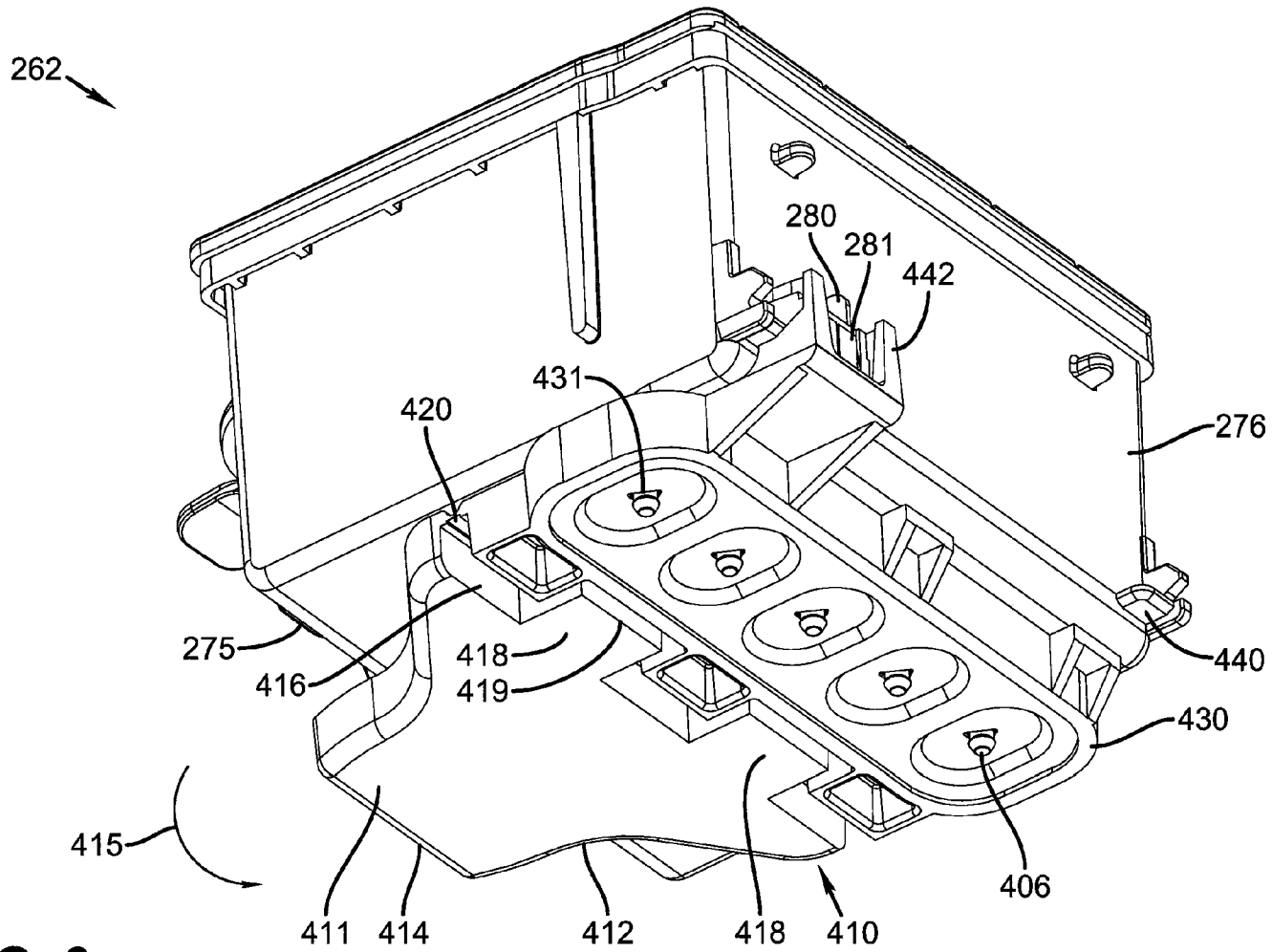
FIG. 9 is a perspective view of a seal retainer affixed to an ink tank according to an embodiment of the invention.

FIG. 9 shows a seal retainer 410 affixed to multi-chamber ink tank 262, as seen from outer face 411 of seal retainer 410. (Seal retainer 410 is shown detached from multi-chamber ink tank in FIG. 10.) Seal retainer 410 includes a housing 430 for the seal member 400 of FIGS. 7 and 8. Projections 406 of the seal member 400 can be seen extending through holes 431 in the housing region. In the example of FIG. 9, holes 431 are preferably triangularly shaped in order to provide a good interference fit with projections 406. Seal retainer 410 includes a handle 412 having a free end 414 and a hinged end 416 that is opposite free end 414. Preferably free end 414 projects beyond first end wall 275 of multi-chamber ink tank 262 so that it is easily accessible to the user. Near hinged end 416 is provided hinge member 420 (disposed between housing 430 and hinged end 416), which is described in more detail below. In the example shown in FIG. 9, two pry arms 418 extend past hinge member 420. Pry arms 418 include a pry edge 419. A portion of pry arms 418 at the attachment face 413 (see FIG. 10) of seal retainer 410 is positioned near the outlet face 271 of multi-chamber ink tank 262). As described below, when the user rotates the free end 414 in handle rotation direction 415, the pry edges 419 of pry arms 418 apply a force in a controlled direction to break attachment members that hold seal retainer 410 onto multi-chamber ink tank 262. Seal retainer also can include a protective extension 442 that provides mechanical protection during shipping and storage for electrical device 281 that is mounted on pedestal 280. In the example shown in FIG. 9, protective extension 442 is located closer to housing 430 than it is to handle 412. Optionally, protective extension 442 can include an opening so that electrical contacts on the face of electrical device 281 can be accessed even with the seal retainer 410 affixed to multi-chamber ink tank 262. In order to facilitate ultrasonic welding of attachment members (described in more detail below) on seal retainer 410, outer face 411 can also include portions 440 that are configured to receive a welding instrument (such as an ultrasonic welding horn).

Figure 10:
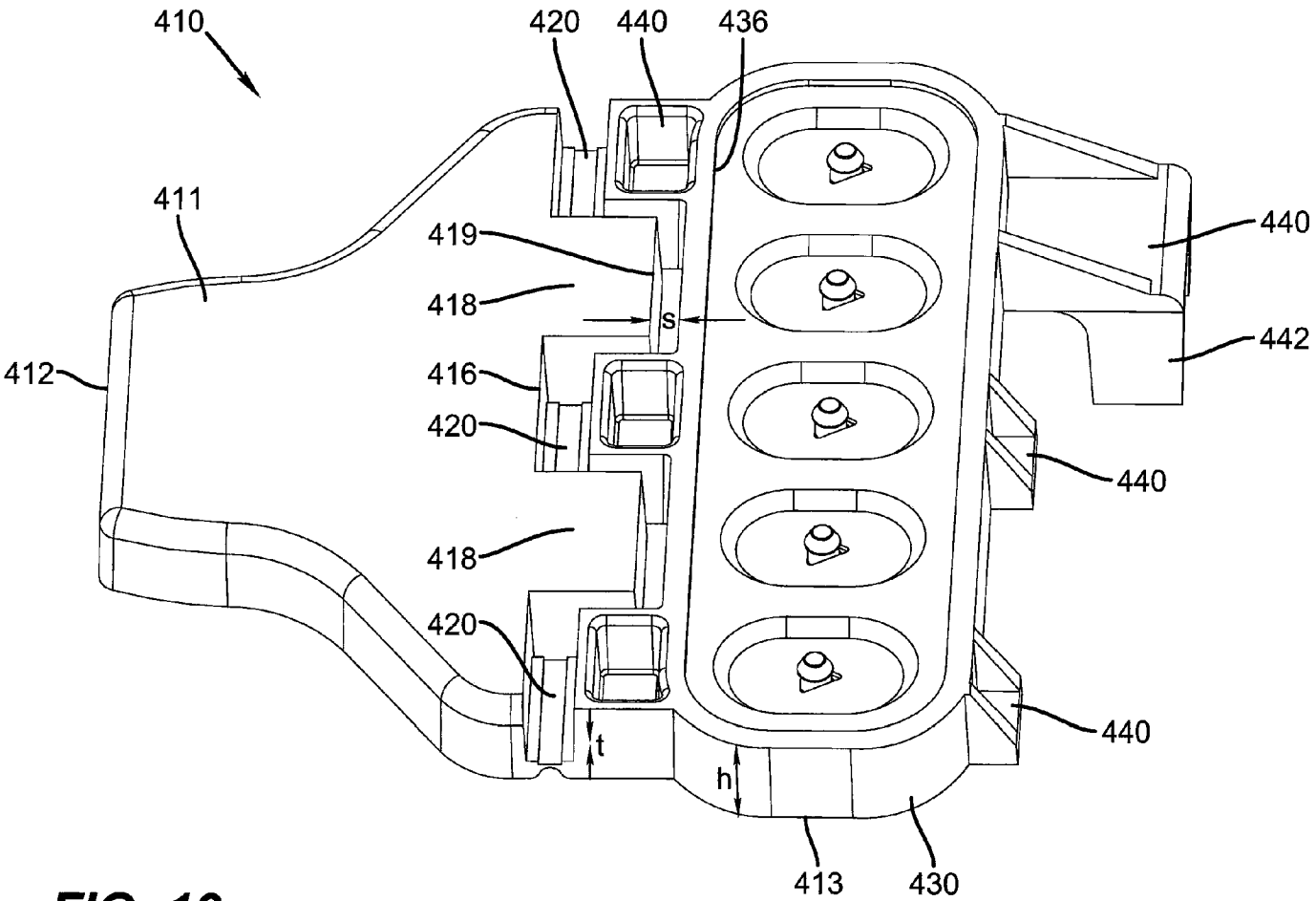
FIG. 10 is a perspective view of the outer face of the seal retainer of FIG. 10.

FIG. 10 shows seal retainer 410 not affixed to multi-chamber ink tank 262 and rotated from the view of FIG. 9, so that some features can be seen more clearly. In this example, hinge member 420 includes three portions that are disposed along a straight line or substantially straight line but that are not immediately adjacent to one another. Rather, a first pry arm 418 is disposed between a first region and a second region of hinge member 420 and a second pry arm 418 is disposed between the second region and a third region of hinge member 420. In an embodiment (not shown) of a seal retainer for a single chamber ink tank, only one pry arm is provided and there are only two regions of the hinge member (one on either side of the pry arm). The number of pry arms and surrounding hinge regions that are appropriate can depend at least in part on the number of outlet ports to be sealed and the number of attachment members that the user needs to break in order to remove the seal retainer. Hinge member 420 is thinned relative to the nominal thickness of the seal retainer and the regions are disposed along a straight line bending axis 422 (see the bottom view shown in FIG. 11). For parts made of plastic, such a thin, flexible hinge joining two rigid plastic parts is usually called a "living hinge". Using injection molding to form the seal retainer 410, the housing 430, the handle 412 and the living hinge between them (hinge member 420) can be integrally formed at one time as a single part. As shown in FIG. 10, the thickness t of hinge member 420 is less than the height h between the outer face 411 of the seal retainer 410 and the attachment face 413 that is opposite the outer face 411. Preferably the thickness t of hinge member 420 is less than one fifth of the height h in order to provide sufficient rigidity to the handle 412 and housing 430, and sufficient flexibility for hinge member 420. The preferred thickness of hinge member 420 can depend upon the material used to form seal retainer 410. As is known in the art, below a certain thickness of injection molded polymers, such as polypropylene, the molecules tend to orient themselves along the mold flow direction, providing a stronger hinge member.

Figure 11:
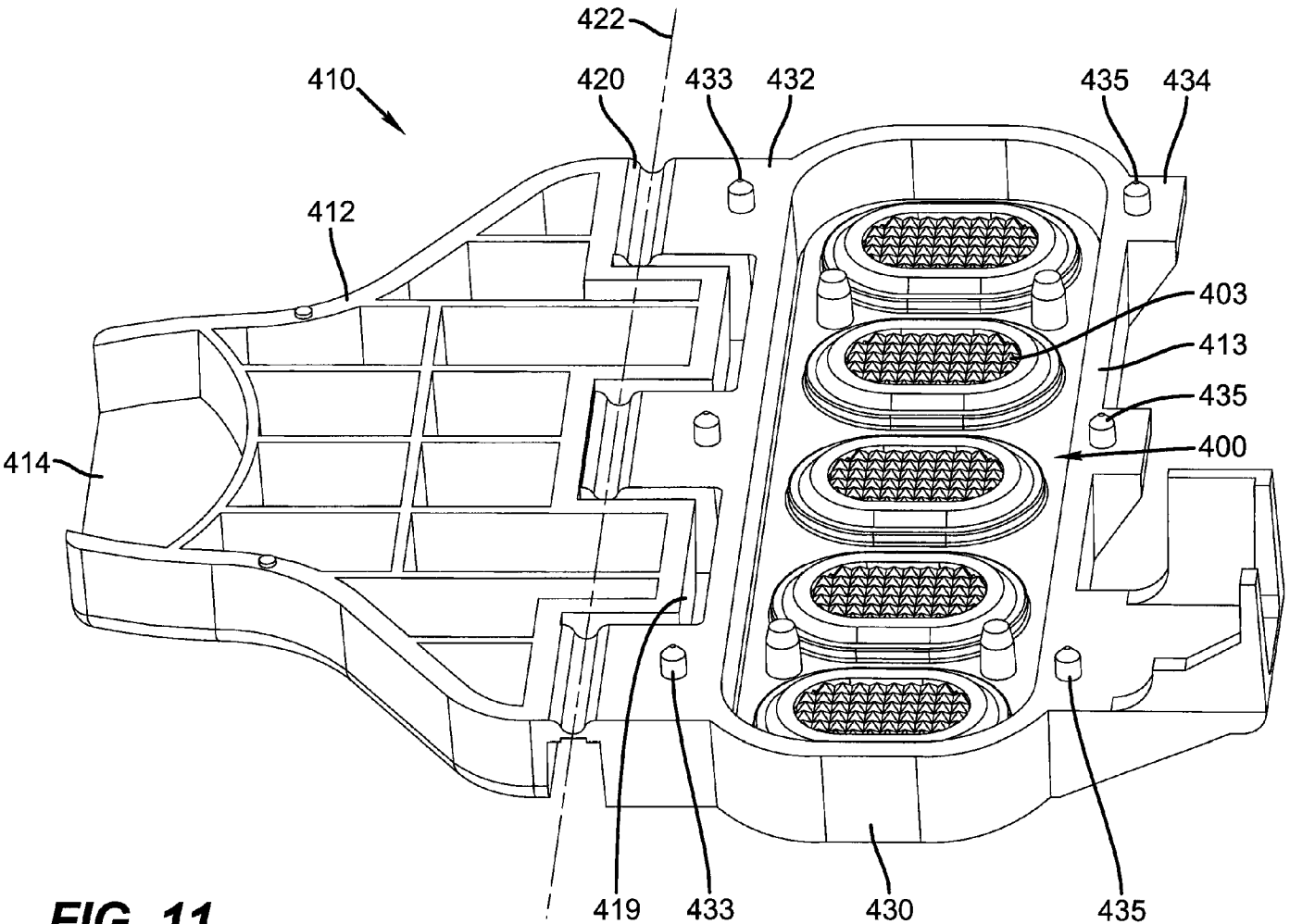
FIG. 11 is a perspective view of the attachment face of the seal retainer of FIG. 10.

FIG. 11 shows a perspective view of the attachment face 413 of seal retainer 410. On a first side 432 of housing 430 are located three attachment members 433, and on a second side 434 (opposite first side 432) are located three attachment members 435. In the embodiment shown in FIGS. 9-12, attachment members 433 and 435 are posts that can be inserted into corresponding recesses 278 of multi-chamber ink tank 262 (see FIG. 6) and then ultrasonically welded so that the seal retainer 410 is affixed to multi-chamber ink tank 262 (see FIG. 9). In other embodiments, attachment members 433 and 435 can be laser welded, heat staked, press fit, or adhesively bonded, for example, to corresponding features on the ink tank. In some embodiments, attachment members 433 and 435 on seal retainer 410 can be recesses or holes and the corresponding features on the ink tank can be posts. The number of attachment members 433 and 435 that are appropriate can depend at least in part on the number of outlet ports to be sealed. In the embodiments shown in FIGS. 6, 11 and 12 there are three attachment members 433 on the first side 432 of housing 430, and three attachment members 435 on the second side 434 of housing 430 (plus corresponding recesses 278 on the ink tank). A first attachment member 433 is located on first side 432 of housing 430 near a port seal 403 corresponding to first end outlet port 273. A second attachment member 435 is located on second side 434 of housing 430 near the port seal 403 corresponding to first end outlet port 273. A third attachment member 433 is located on first side 432 of housing 430 near a port seal 403 corresponding to second end outlet port 274. A fourth attachment member 435 is located on second side 432 of housing 430 near the port seal 403 corresponding to second end outlet port 274. In other words, both end port seals 403 are securely sealed to end outlet ports 273 and 274 respectively by having a nearby attachment member 433 on the first side 432 of housing 430 as well as a nearby attachment 435 on the second side 434 of housing 430. A fifth attachment member 433 is located on first side 432 of housing 430 near a port seal 403 corresponding to the outlet port 272 in the middle of the row of outlet ports on multi-chamber ink tank 262 (see FIG. 6). A sixth attachment member 435 is located on second side 434 of housing 430 near a port seal 403 corresponding to the outlet port 272 in the middle of the row of outlet ports on multi-chamber ink tank 262. Other configurations of attachment members are appropriate for other outlet port configurations. For example, in an embodiment of a seal retainer (not shown) for a single chamber ink tank, there can be two attachment members on the first side of the housing, located on opposite sides of a pry arm, and one attachment member on the second side of the housing.

Figure 12:
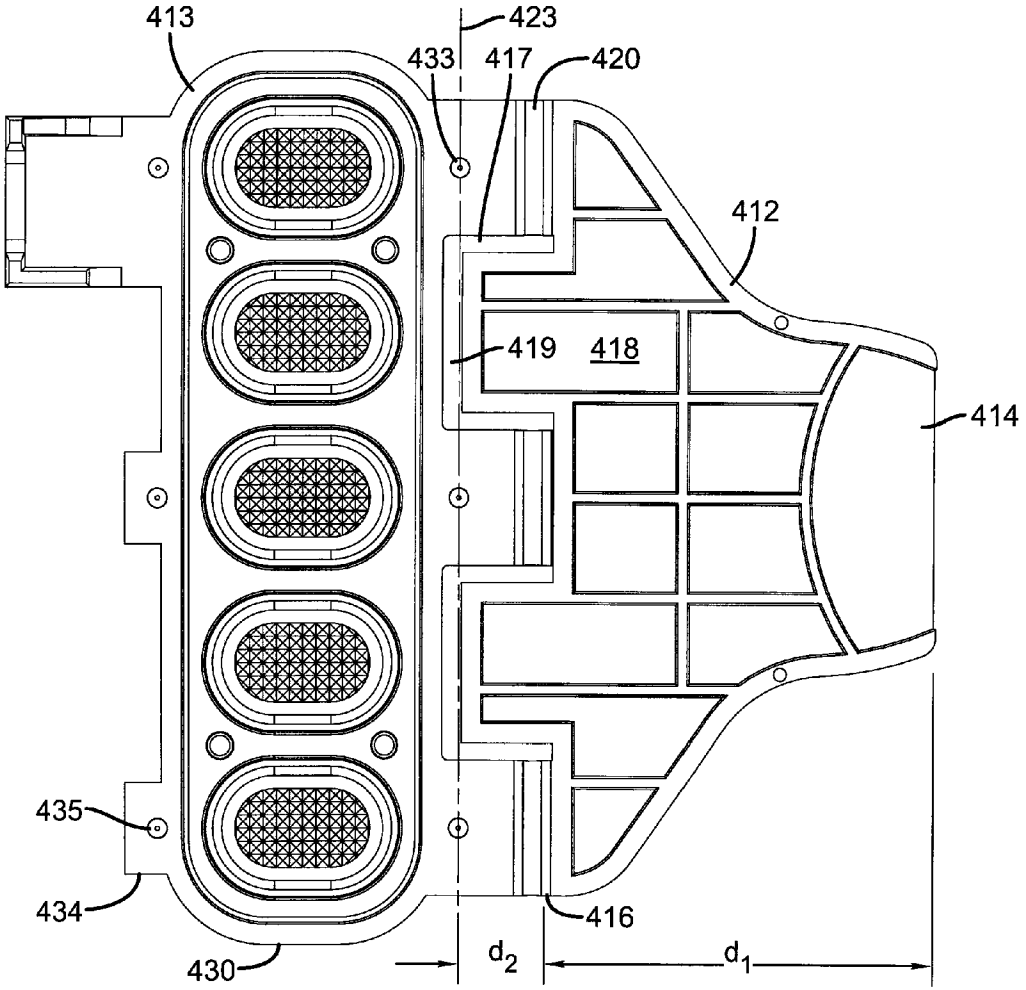
FIG. 12 is a bottom view of the attachment face of the seal retainer of FIG. 10.

In order for the seal retainer 410 to be bendable along bending axis 422, the pry arms 418 that extend past hinge member 420 need to be detached from seal retainer 410 along pry edge 419 as well as along the sides of pry arms 418 extending from the hinge member 420 regions to the pry edge 419, as shown more clearly in FIG. 12. For example, during formation of the seal retainer 410 the injection molding tool for seal retainer 410 allows plastic to flow into a thin region corresponding to hinge member 420, but blades or other features of the injection molding tool prevent plastic from flowing into the areas adjacent to the pry edge 419 or the sides 417 of pry arms 418, so that the pry arms are detached from seal retainer 410 in these areas.

In some embodiments, pry edges 419 of pry arms 418 are located along a line 423 of attachment members 433 on first side 432 of housing 430. In particular, a pry edge 419 is disposed substantially linearly between one attachment member 433 and the next attachment member 433. This makes it possible for the pry arms 418 to apply the breaking force precisely where it is needed to break the weld joints between attachment features 433 and recesses 278 of multi-chamber ink tank 262. In order to provide a suitable amount of leverage for applying the breaking force, it is preferred that a distance $d_1$ between the free end 414 of handle 412 and the hinged end 416 of handle 412 be greater than a distance $d_2$ between the hinged end 416 and the pry edge 419 of pry arm 418 as shown in FIG. 12.

When the user rotates the free end 414 of handle 412 along handle rotation direction 415 (see FIG. 9) the weld joints of attachment members 433 on first side 432 of housing 430 break first. In order to provide leverage such that further rotation of free end 414 of handle 412 also breaks the weld joints of attachment members 435 on second side 434 of housing 430, it is preferable that a distance s between the pry edge 419 of pry arm 418 and a nearby wall 436 of housing 430 be less than the height h between attachment face 413 and outer face 411 of seal retainer 410, as shown in FIG. 10. By keeping s less than h it ensures that upon further rotation of handle 412 along rotation direction 415, the top of pry edge 419 (at outer face 411) hits wall 436. This stops the free rotation of handle 412 around bending axis 422 of hinge member 420, so that the further rotation of the handle applies a breaking force to attachment members 435 on second side 434 of housing 430. Thus the breaking of all weld joints is easily accomplished by a simple rotation of handle 412 in order to remove seal retainer 410 before the user installs the ink tank into the printer.

Having described the features of seal retainer 410 and ink tank 262 it is now possible to describe a method of providing a detachable seal for at least one outlet port of an ink tank. Seal member 400 is provided with housing 430 of seal retainer 410. An ink tank 262 including a plurality of attachment features (such as recesses 278) corresponding to attachment members 433 and 435 on seal retainer 410 is also provided. Seal retainer 410 is aligned to ink tank 262 such that attachment members 433 and 435 are aligned with the attachment features of the ink tank. The seal retainer 410 is pressed against ink tank 262 such that the seal member 400 is in contact with at least one outlet port of ink tank 262. The attachment members 433 and 435 of seal retainer 410 are then affixed to the attachment features of ink tank 262.

As described above, seal retainer 410 can be made by injection molding to include a living hinge 420, such that a thickness of the living hinge is less than a height between an attachment face 413 and an outer face 411 of the seal retainer 410. Preferably the living hinge 420 is disposed in a plurality of regions along a bending axis 422 of the seal retainer 410 with a pry arm 418 disposed between a first region and a second region of the living hinge 420. During injection molding, the flow of plastic used to form the seal retainer is restricted such that plastic is not allowed to flow to a first detachment region located between the pry arm edge 419 and housing 430. Plastic is also not allowed to flow to a second detachment region located on the sides 417 of pry arm 418 between the living hinge 420 and the first detachment region.

As described above, elastomeric seal member 400 can be attached within housing 430, for example by press fitting projections from seal member 400 into holes 431 in housing 430. Alternatively, seal member 400 can be provided by molding as a second shot mold during injection molding.

During alignment of the seal retainer 410 to ink tank 262, in some embodiments a protective extension 442 of seal retainer 410 is positioned to be near an electrical device 281 mounted on an end wall 276 of ink tank 262 in order to provide mechanical protection for the device in case the ink tank 262 is dropped, for example.

When the seal retainer 410 is pressed against the ink tank 262, preferably the seal member 400 deforms elastically against the at least one outlet port 272 of ink tank 262 in order to provide a compliant seal that inhibits evaporative loss of volatile ink components from ink tank 262. In addition, when the seal retainer 410 is pressed against ink tank 262, a portion of pry arm 418 at the attachment face 413 of seal retainer 410 is caused to be in contact with or next to the outlet face 271 of ink tank 262.

Attachment members 433 and 435 of the seal retainer 410 can include posts that correspond to holes 278 (also sometimes called recesses 278 herein) in ink tank 262. Alternatively, attachment members 433 and 435 of the seal retainer 410 can include holes (also sometimes called recesses herein) that correspond to posts on outer face 271 of ink tank 262. Affixing the attachment members of the seal retainer 410 to the attachment features of the ink tank 262 can be done by ultrasonic welding, laser welding, heat staking, press fitting, adhesive bonding, or other such ways of attachment.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
240 Standpipe
241 Region (for mounting multi-chamber ink tank)
242 Inlet port
243 Hole
244 Hole
245 End
246 Region (for mounting single chamber ink tank)
249 Wall
250 Printhead
251 Printhead die
253 Nozzle array
254 Nozzle array direction
256 Encapsulant
257 Flex circuit
258 Connector board
262 Multi-chamber ink tank
264 Single-chamber ink tank
270 Body
271 Outlet face
272 Outlet port
273 End outlet port
274 End outlet port
275 End wall
276 End wall
277 Wick
278 Recess or hole
280 Pedestal
281 Electrical device
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium

380 Carriage motor
382 Carriage guide rail
383 Encoder fence
384 Belt
390 Printer electronics board
392 Cable connectors
400 Seal member
402 Sealing face
403 Port seal
404 Alignment post
405 Attachment face
406 Projection
410 Seal retainer
411 Outer face
412 Handle
413 Attachment face
414 Free end
415 Handle rotation direction
416 Hinged end
417 Side (of pry arm)
418 Pry arm
419 Pry edge
420 Hinge member
422 Bending axis
423 Line (of attachment members)
430 Housing
431 Hole
432 First side of housing
433 Attachment members
434 Second side of housing
435 Attachment members
436 Wall
440 Portions for welding instrument
442 Protective extension

The invention claimed is:

1. A seal for at least one outlet port of an ink tank, the seal comprising:
- a seal member; and
- a seal retainer comprising;
  - a housing for the seal member;
  - a first attachment member on a first side of the housing;
  - a second attachment member on a second side of the housing, the second side being opposite the first side;
  - a handle including a free end and a hinged end opposite the free end; and
  - a hinge member disposed between the housing and the hinged end of the handle.

2. The seal of claim 1, wherein the seal retainer further comprises:
- an attachment face including the attachment members; and
- an outer face opposite the attachment face and disposed at a height h from the attachment face, wherein a thickness t of the hinge member is less than the height h.

3. The seal of claim 2, wherein the hinge member comprises at least one portion that is disposed along a straight line.

4. The seal of claim 3, wherein the at least one portion comprises a first region and a second region, and wherein the seal retainer further comprises a pry arm disposed between the first region and the second region.

5. The seal of claim 4, the pry arm comprising:
- a pry edge disposed proximate the housing;
- a first side extending from the first region of the hinge member to the pry edge; and
- a second side extending from the second region of the hinge member to the pry edge, wherein the pry edge, the first side and the second side of the pry arm are detached from the seal retainer.

6. The seal of claim 5, the seal retainer further comprising a third attachment member on the first side of the housing, wherein the pry edge is disposed substantially linearly between the first attachment member and the third attachment member.

7. The seal of claim 5, wherein a distance between the free end of the handle and the hinged end of the handle is greater than a distance between the hinged end of the handle and the pry edge of the pry arm.

8. The seal of claim 5 further comprising a wall disposed between the housing and the pry edge of the pry arm, wherein a distance between the pry edge and the wall is less than the height h.

9. The seal of claim 1, wherein the first and second attachment members comprise weldable posts.

10. The seal of claim 1, wherein the seal member is formed of an elastomeric material.

11. The seal of claim 1, wherein the seal member comprises a sealing face and an attachment face opposite the sealing face, the attachment face including at least one projection for press fitting into a corresponding hole in the housing.

12. The seal of claim 1 further comprising a protective extension disposed proximate to the housing and distal to the handle.

13. An ink tank for an inkjet printhead, the ink tank comprising:
- an ink tank body including an outlet face having at least one outlet port for providing ink; and
- a seal for the at least one outlet port, the seal comprising:
  - a seal member; and
  - a seal retainer comprising;
    - a housing for the seal member;
    - a first attachment member on a first side of the housing;
    - a second attachment member on a second side of the housing, the second side being opposite the first side;
    - a handle including a free end and a hinged end opposite the free end; and
    - a hinge member disposed between the housing and the hinged end of the handle.

14. The ink tank of claim 13, the ink tank body further comprising a first end wall extending from a first edge of the outlet face and a second end wall extending from a second edge of the outlet face opposite the first edge, wherein the free end of the handle projects beyond the first end wall.

15. The ink tank of claim 14, the seal further comprising a protective extension disposed proximate to the housing and distal to the handle, wherein the protective extension projects beyond the second end wall of the ink tank body.

16. The ink tank of claim 15 further comprising a device mounted on the second end wall of the ink tank body, wherein a portion of the protective extension is proximate the device.

17. The ink tank of claim 13, wherein the outlet face of the ink tank body further comprises a plurality of attachment configured to be affixed to the attachment members of the seal retainer.

18. The ink tank of claim 17, wherein the seal retainer further comprises an attachment face including the attachment members and an outer face opposite the attachment face, and wherein the portions of the outer face that are opposite the attachment members are configured to receive a welding instrument for welding the attachment members to the attachment features in the outlet face of the ink tank body.

19. The ink tank of claim 17, wherein the attachment members are affixed to the attachment features in the outlet face of the ink and wherein the seal member is pressed against the at least one outlet port.

20. The ink tank of claim 19, wherein the seal retainer further comprises a pry arm, and wherein a portion of the pry arm is disposed proximate a portion of the outlet face of the ink tank body.

21. The ink tank of claim 13, the ink tank body comprising a plurality of outlet ports disposed in a row on the outlet face, the row including a first end outlet port and a second end outlet port, the seal retainer further comprising a third attachment member on the first side of the housing and a fourth attachment member on the second side of the housing, wherein:

the first attachment member and the second attachment member are disposed proximate the first end outlet port; and the third attachment member and the fourth attachment member are disposed proximate the second end outlet port.

* * * * *